US009538813B1

(12) United States Patent
Schwank et al.

(10) Patent No.: US 9,538,813 B1
(45) Date of Patent: Jan. 10, 2017

(54) ENERGY ABSORBING ELEMENTS FOR FOOTWEAR AND METHOD OF USE

(71) Applicant: Akervall Technologies, Inc., Saline, MI (US)

(72) Inventors: Johann Walter Schwank, Ann Arbor, MI (US); Jan Anders Akervall, Ann Arbor, MI (US); Valarie Thomas, Ann Arbor, MI (US); Timothy Huang, Ann Arbor, MI (US)

(73) Assignee: Akervall Technologies, Inc., Saline, MI (US)

( * ) Notice: Subject to any disclaimer, the term of this patent is extended or adjusted under 35 U.S.C. 154(b) by 0 days.

(21) Appl. No.: 15/179,039

(22) Filed: Jun. 10, 2016

Related U.S. Application Data

(60) Provisional application No. 62/207,614, filed on Aug. 20, 2014.

(51) Int. Cl.

| | |
|---|---|
| ***A43B 13/18*** | (2006.01) |
| ***A43B 17/02*** | (2006.01) |
| ***A43B 5/00*** | (2006.01) |
| ***A43B 17/00*** | (2006.01) |

(52) U.S. Cl.
CPC ..... *A43B 17/026* (2013.01); *A43B 5/00* (2013.01); *A43B 13/18* (2013.01); *A43B 17/006* (2013.01)

(58) Field of Classification Search
CPC ..... A43B 7/08; A43B 13/18; A41D 1/00; G01N 30/00
USPC .. 36/27, 28, 29, 35 R, 35 B, 141; 428/304.4, 428/34.1
See application file for complete search history.

(56) References Cited

U.S. PATENT DOCUMENTS

| | | | | |
|---|---|---|---|---|
| 413,693 | A | 10/1889 | Walker | |
| 2,145,778 | A * | 1/1939 | Nenni | A43B 21/06 36/35 R |
| 2,710,460 | A * | 6/1955 | Stasinos | A43B 13/182 36/28 |
| 2,885,797 | A * | 5/1959 | Chrencik | A43B 13/186 36/104 |
| 2,930,149 | A | 3/1960 | Hack | |
| 3,253,355 | A * | 5/1966 | Menken | A43B 13/20 36/29 |
| 4,146,981 | A | 4/1979 | Renaldo | |
| 4,183,156 | A | 1/1980 | Rudy | |
| 4,219,945 | A | 9/1980 | Rudy | |
| 4,223,456 | A | 9/1980 | Cohen | |
| 4,231,169 | A | 11/1980 | Toyama | |
| 4,340,626 | A | 7/1982 | Rudy | |
| 4,358,902 | A | 11/1982 | Cole | |
| 4,364,188 | A | 12/1982 | Turner | |
| 4,391,048 | A | 7/1983 | Lutz | |
| 4,458,430 | A | 7/1984 | Peterson | |
| 4,521,979 | A | 6/1985 | Blaser | |
| 4,535,553 | A | 8/1985 | Derderian | |
| 4,597,195 | A | 7/1986 | Dananberg | |
| 4,614,046 | A | 9/1986 | Dassler | |
| 4,651,445 | A | 3/1987 | Hannibal | |
| 4,670,995 | A | 6/1987 | Huang | |

(Continued)

*Primary Examiner* — Marie Bays
(74) *Attorney, Agent, or Firm* — Marshall & Melhorn, LLC

(57) ABSTRACT

An energy absorbing element for footwear has a first set of open spaces and a second set of open spaces in a layer of material. The first set of open spaces and the second set of open spaces each have arrays of open spaces. Each array of open spaces has a certain number of open spaces. The arrays are arranged in a particular pattern.

23 Claims, 4 Drawing Sheets

(56) References Cited

U.S. PATENT DOCUMENTS 4,722,131 A 2/1988 Huang
4,768,295 A 9/1988 Ito
4,774,774 A 10/1988 Allen, Jr.
4,798,009 A 1/1989 Colonel
4,815,221 A 3/1989 Diaz
4,817,304 A 4/1989 Parker
4,843,737 A 7/1989 Vorderer
4,864,737 A 9/1989 Marrello
4,881,329 A 11/1989 Crowley
4,910,884 A 3/1990 Lindh
4,918,838 A 4/1990 Chang
4,936,029 A 6/1990 Rudy
4,946,721 A 8/1990 Kindervater
4,956,927 A * 9/1990 Misevich ..... A43B 13/14 36/11
4,999,931 A 3/1991 Vermeulen
5,042,175 A 8/1991 Ronen
5,042,176 A 8/1991 Rudy
5,077,916 A 1/1992 Beneteau
5,092,060 A 3/1992 Frachey
5,195,257 A 3/1993 Holcomb
5,282,325 A 2/1994 Beyl
5,311,674 A 5/1994 Santiyanont
5,343,639 A 9/1994 Kilgore
5,381,608 A 1/1995 Claveria
5,435,079 A 7/1995 Gallegos
5,493,791 A * 2/1996 Kramer ..... A43B 7/081 36/28
5,544,431 A 8/1996 Dixon
5,551,173 A * 9/1996 Chambers ..... A43B 7/146 36/141
5,575,088 A 11/1996 Allen
5,685,090 A 11/1997 Tawney
5,699,627 A * 12/1997 Castro ..... A43B 1/0045 36/28
5,704,137 A * 1/1998 Dean ..... A43B 17/03 36/28
5,706,589 A 1/1998 Marc
5,718,064 A 2/1998 Pyle
5,743,028 A 4/1998 Lombardino
5,839,209 A * 11/1998 Healy ..... A43B 13/181 12/146 BR
5,915,819 A 6/1999 Gooding
5,979,078 A 11/1999 McLaughlin
6,004,662 A * 12/1999 Buckley ..... A61F 7/02 152/310
6,023,859 A 2/2000 Burke
6,055,747 A 5/2000 Lombardino
6,061,929 A 5/2000 Ritter
6,183,855 B1 * 2/2001 Buckley ..... A61F 7/02 165/104.11
6,205,681 B1 3/2001 Kita
6,457,261 B1 10/2002 Crary
6,516,539 B2 2/2003 Nishiwaki
6,751,891 B2 6/2004 Lombardino
7,475,497 B2 * 1/2009 Hoffer ..... A43B 1/0009 36/28
7,774,954 B2 * 8/2010 Hoffer ..... A43B 1/0009 36/28
7,997,012 B2 * 8/2011 Hoffer ..... A43B 1/0009 36/28
8,453,344 B2 6/2013 Nishiwaki
8,615,835 B2 * 12/2013 Hoffer ..... A43B 1/0009 12/142 R
8,973,287 B2 3/2015 Shibata
2001/0000272 A1 * 4/2001 Attilieni ..... A43B 7/08 36/3 A
2004/0098882 A1 * 5/2004 Tuan ..... A43B 7/144 36/29
2005/0097777 A1 * 5/2005 Goodwin ..... A43B 13/20 36/29
2006/0156579 A1 * 7/2006 Hoffer ..... A43B 1/0009 36/28
2006/0225304 A1 * 10/2006 Goodwin ..... A43B 13/20 36/35 B
2008/0066342 A1 * 3/2008 Park ..... A43B 7/144 36/29
2009/0100722 A1 * 4/2009 Hoffer ..... A43B 1/0009 36/3 R
2010/0281712 A1 * 11/2010 Campbell ..... A43B 7/1425 36/28
2012/0027972 A1 * 2/2012 Kapur ..... G05D 23/192 428/35.7
2012/0114883 A1 * 5/2012 Kapur ..... B32B 38/04 428/34.1
2014/0090271 A1 * 4/2014 Hoffer ..... A43B 1/0009 36/29
2015/0013191 A1 1/2015 Brown
2015/0143713 A1 5/2015 Cheng
2015/0157091 A1 6/2015 Hsu
2016/0037860 A1 * 2/2016 Holt ..... A43B 13/186 36/28
2016/0095385 A1 * 4/2016 Nordstrom ..... A43B 13/181 36/29
2016/0108194 A1 * 4/2016 Topolkaraev ..... C08L 67/04 428/76

* cited by examiner

ENERGY ABSORBING ELEMENTS FOR FOOTWEAR AND METHOD OF USE

RELATED APPLICATIONS

The present application claims priority to and the benefit of U.S. Patent Application Ser. No. 62/207,614 filed Aug. 20, 2014.

TECHNICAL FIELD

The present invention relates generally to a novel energy absorbing element for footwear and a method of using the element to absorb energy such as impacts.

BACKGROUND

In footwear, and specifically in athletic shoes, soles are typically comprised of several distinct layers, for example an outsole, midsole, and insole. The outsole is made of wear-resistant, tough material, and is patterned in such a way as to provide good traction and slip resistance. The outsole is typically in direct contact with the ground and the outermost layer of the footwear. The insole is designed for comfort and is typically made of soft cushioning material. By placing an appropriate midsole structure and/or material between the outsole and the insole, it is possible to provide a certain degree of shock absorption.

By way of one example, soles for walking shoes may be comprised of a flexible PVC outsole, a low density polyurethane insert for shock absorption, and a multilayered foot bed incorporating EVA, latex, and polyester (see for example U.S. Pat. No. 5,718,064).

Strategies for improving the shock absorptive properties of athletic footwear often include the use of compressible viscoelastic materials that are incorporated as insole or midsole elements under the foot or heel of the wearer. The purpose is to dissipate some of the impact energy when the heel strikes the ground during running or jumping.

A number of materials and designs have been used to address the need for improved shock absorption of midsoles. For example, open or closed cell elastomeric foams of different stiffness have been deployed in different areas of the midsole (see for example U.S. Pat. No. 4,614,046 and U.S. Pat. No. 4,364,188). These foams may be comprised of polymers such as polyurethane, polyethylene, or ethylene-vinyl acetate, also known as EVA.

An alternative is to insert air-filled bags within elastomeric foams (see U.S. Pat. No. 4,871,304). Other patents, (such as U.S. Pat. Nos. 4,535,553 and 5,343,639) teach midsoles that combine elastomeric foams with discretely spaced plastic projections, or a number of elastomeric foam columns between the upper and lower plates in the heel of the shoe, while the hollow spaces between the columns are filled with gas bladders.

Other patents teach the incorporation of gas filled bladders into soles (see U.S. Pat. Nos. 4,183,156, 4,219,945, 4,340,626, 4,936,029, 5,042,176 and 5,685,090) or a bladder composite comprised of an inner and outer bladder filled with cushioning or supporting fluids (see U.S. Pat. No. 5,979,078).

U.S. Pat. No. 5,915,819 teaches an adaptive, energy absorbing structure comprised of a plurality of fluid filled hexagonal cells joined together by passageways allowing fluid to intercommunicate. Pressure responsive seals are included that restrict the fluid flow between cells when a mechanical force exceeds a certain threshold level.

A similar concept is taught by U.S. Pat. No. 5,575,088 where concentric fluid filled toroids are contained in the midsole. To provide more stability and to address the problem of pronation during running that can lead to injury, some manufacturers of athletic shoes have incorporated midsoles that are less compressible and harder on the medial side of the heel midsole (see U.S. Pat. No. 4,614,046 and U.S. Pat. No. 4,364,188).

To provide better arch support, a molded shank can be integrated (see U.S. Pat. No. 6,061,929). Alternatively, springs (U.S. Pat. Nos. 5,042,175; 5,282,325; 5,381,608; 5,435,079; 5,743,028; 6,055,747, and U.S. Publication No. 2015/0013191) or resilient materials (see U.S. Pat. Nos. 5,092,060; 5,311,674) can be incorporated that are intended to not only provide cushioning, but also return some energy.

However, such energy return can contribute to enhanced shock to an athlete. The spring action within the heel of a shoe can to some extent be adjusted by inserting foam rubber inserts of varying density (see U.S. Pat. No. 5,544,431). To reduce the amount of detrimental energy return, telescopic shock absorbers have been incorporated (see U.S. Pat. No. 6,457,261).

The shock absorbers can have two stages with different compression levels, namely a first stage that provides cushioning at low levels of load, such as walking, and a second stage that is able to absorb the higher loads from activities such as jumping or running.

Typical impact energy absorbing materials used in footwear are open or closed cell foams of various thermoplastic polymers including polyurethane, polyethylene, polystyrene, as well as foams or dense bodies of elastomeric polymers, including silicones, ethylene vinyl acetate (EVA), ethylene-propylene rubbers (EPM), ethylene-propylene-diene rubbers (EPDM). In addition to single component materials, various composite materials have been reported. Many of these materials contain mixtures of polyethylene with fibers (see U.S. Pat. No. 4,946,721). Other approaches include composites of rigid hollow spheres encapsulated in an elastomeric matrix (see U.S. Pat. No. 4,101,704), or composites of elastomers with fillers (see U.S. Pat. No. 4,082,888).

There have also been attempts to improve the impact energy absorption capacity of materials by laminating different layers together. For example, European Patent EP 0 955 211 B1 teaches impact energy absorbing materials for protective athletic gear using layers of expanded polytetrafluoroethylene (ePTFE) and at least one layer of an elastomer. U.S. Pat. No. 6,023,859 teaches an insertable member of the midsole. U.S. Pat. No. 6,205,681 teaches the use of a midsole that is formed from a soft elastic material and a corrugated sheet in the heel portion. The patent claims that the cushioning properties of the shoe can be improved by introducing holes in the midsole at locations where the midsole contacts the corrugated sheet, thereby facilitating vertical deformation. U.S. Pat. No. 8,453,344 describes a sole that has a reinforcing member in the midsole comprised of several interconnecting blades. U.S. Pat. No. 8,973,287 describes a sole plate that has a number of blades that are standing on it vertically. The sole plate is bonded to a cover, and a fluid is sealed in between the sole plate and the cover. The purpose of the fluid is to provide movement during walking that massages the foot with the blades. U.S. Publication No. 2015/0143713 describes a multi-function shoe pad that includes a hollow bulge forming an air filled chamber that is deformable between a compressed and uncompressed state, so that hot air can move out and cold air can move in to provide cooling. U.S. Publication No. 2015/0157091 teaches a shock absorbing and pressure releasing damper apparatus.

Based on the brief description of the selected prior art above, it is clear that most ways current footwear manufacturers attempt dissipate energy is to use pliable, relatively soft materials. The underlying theory for this design is the idea that soft materials should be able to cushion against impact. These materials, however, because of their composition, shape and orientation in the footwear are designed to only vertically compress, which permits a large portion of the impact energy to be transferred to the foot.

In view of disadvantages of the prior art design, it would be advantageous to use a relatively hard polymeric material that has lower compressibility compared to conventional insole materials. As such, the insoles are better able to convert the kinetic energy during an impact into heat and sound and reversible deformations of the boundaries of open spaces in the material, thereby lessening the remaining forces transmitted to the heel or forefoot.

SUMMARY OF THE PRESENT DISCLOSURE

An energy absorbing element for footwear has a first set of open spaces and a second set of open spaces in a layer of material. The first set of open spaces and the second set of open spaces are each comprised of arrays of open spaces. Each array of open spaces has a certain number of open spaces. The arrays are arranged in a particular pattern.

BRIEF DESCRIPTION OF THE DRAWINGS

The features of the subject invention will be better understood in the context of the detailed description, in conjunction with the drawings in which.

DESCRIPTION OF EXAMPLE EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
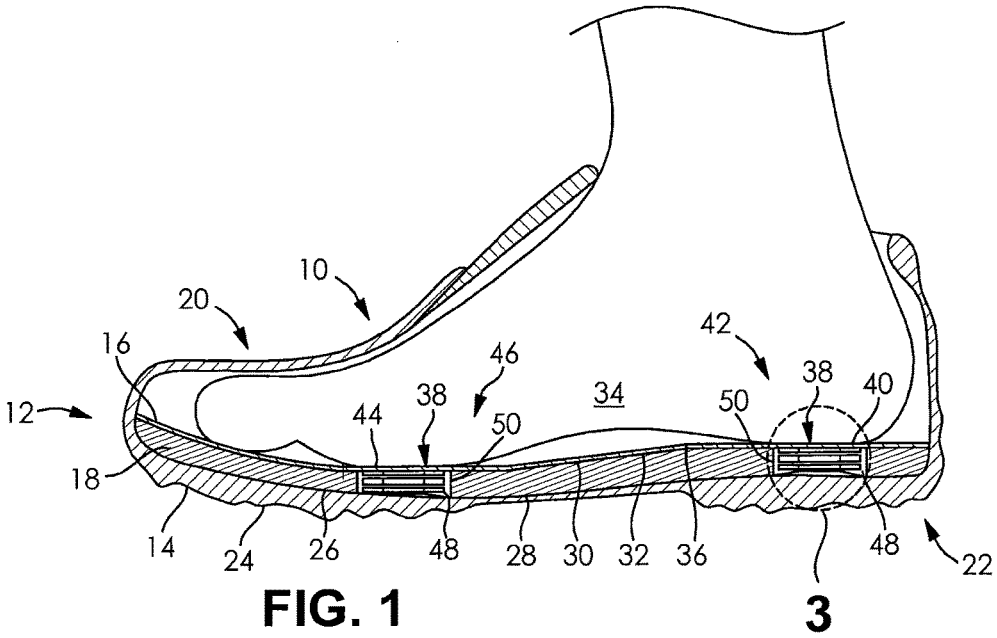
FIG. 1 is a cutaway side view of one embodiment of a foot in a piece of footwear wherein a layer of material and additional layers from the footwear are shown in an exploded orientation.

Turning now to FIG. 1, one embodiment of a piece of footwear 10 is schematically depicted. The footwear 10 has the appearance of an athletic type shoe, such as a running shoe, cross training shoe, tennis shoe or trail running shoe. The footwear 10, however, is not limited to these types of shoes. Instead, the footwear 10 may be any kind for any sport or even non-sporting shoes.

The footwear 10 depicted in FIG. 1 has a sole 12 comprised of an outsole 14, an insole 16 and a midsole 18. The outsole 14 may be comprised of a flexible, resilient and tough, rubber-like material leather and/or synthetic material. In many cases, the outsole 14 extends from a toe box portion 20 to a heel portion 22 of the footwear. The outsole 14 is usually the lowermost material of the footwear 10 and being the outermost layer it is designed to be in direct contact with the ground. More particularly, an outer surface 24 of the outsole 14 is in contact with the ground, while the opposite side of the outsole 14, an inner surface 26, is located against the midsole 18.

The midsole 18 is typically located radially inward from the outsole 14. In many cases, an outer surface 28 of the midsole 18 is in direct contact with the inner surface 26 of the outsole 14. The midsole 18 has an inner surface 30 opposite the midsole outer surface 28. As shown in FIG. 1, the midsole 18 extends from the toe box portion 20 to the heel portion 22 of the footwear 10. The inner surface 30 of the midsole 18 is located against the insole 16.

The insole 16 is located radially inwardly from the midsole 18. Usually, an outer surface 32 of the insole 16 is located against the inner surface 30 of the midsole 18. The insole 16 extends from the toe box portion 16 to the heel portion 22 of the footwear 10. As shown in FIG. 1, the insole 16 is the last inner layer of the footwear 10, and the user's foot 34 is in direct contact with an inner surface 36 of the insole 16.

An energy absorbing element comprising an insert system 38 may be located in the sole 12 of the footwear 10. FIG. 1 depicts the insert system 38 located entirely within the midsole 18, but the insert system 38 can be only partly located in the midsole 18. In the case where the insert system 38 is only partly located in the midsole 18, the system 38 can extend into the insole 16 or the outsole 14.

FIG. 1 depicts two insert systems 38 in the footwear 10. While two insert systems 38 are depicted in FIG. 1, only a single insert system 38 may be used, or a plurality of insert systems 38 may be used.

The two insert systems 38 of FIG. 1 are depicted in certain locations. A first insert system 40 is located radially below a heel portion 42 of the foot 34. A second insert system 44 is located radially below the plantar fascia and/or metatarsals area 46 of the foot 34. While the two systems 40, 44 are depicted in certain locations in FIG. 1, the invention is not limited to these locations.

The above, as well as FIG. 1, suggest that the insert system 38 is something that is inserted into a layer of footwear 10. While that may be the case, the invention is not limited to an insert per se. Instead, the invention can also be readily adapted to an inlay that can be located above or below the existing layers, such as the outsole 14, the insole 16 and/or the midsole 18. For example, the above-described insert system 38 can be its own discrete layer that is above or below the midsole 18, or any other layer 14 or 16.

The inlay, like the insert system 38, can be permanently affixed or attached to the footwear 10, or it may be removable. In the embodiment where the insert system 38 is permanently affixed to the footwear 10, it might be molded into the midsole 18 so that it is one-piece and unitary with the midsole 18. In the embodiment where the insert system 38 is removable, it may be located within a pocket 48 within the midsole 18 layer, such as shown in FIG. 1. In that embodiment, the insert system 38 may be placed within the pocket 48 with some tolerance between the edges of the insert system 38 and the pocket 48 so that the insert system 38 is captured in the pocket 48 and between the layers but permitted some degree of movement.

Preferably, however, the insert system 38 is located within the pocket 48 and secured in place so there is no relative movement between the insert system 38 and the pocket 48. In that case, the insert system 38 may be frictionally coupled with at least one of the walls 50 of the pocket 48, or an adhesive, or any polymer, may be used to secure the insert system 38 within the pocket 48.

Figure 3:
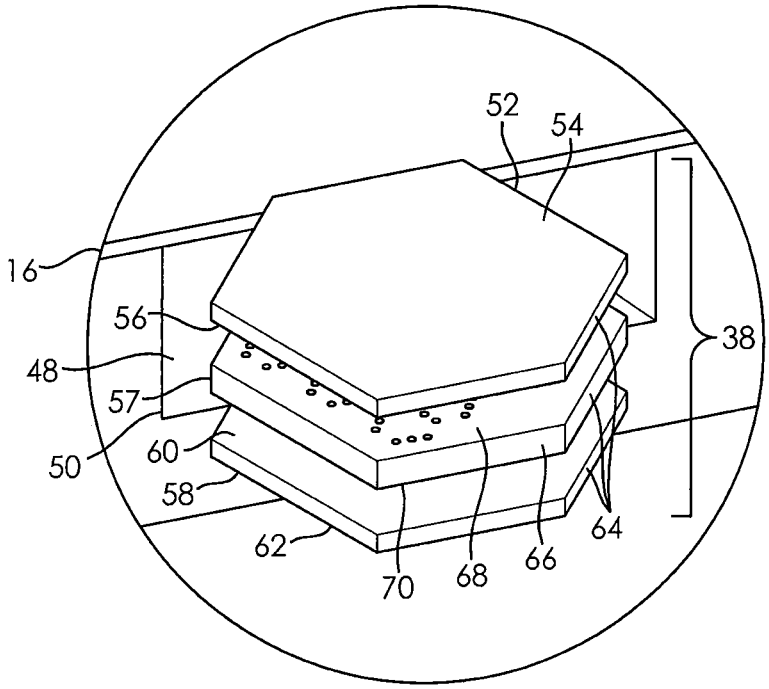
FIG. 3 is a detail from FIG. 1 showing layers of material in an exploded view.

The insert system 38 may be comprised of a single layer or multiple layers. As shown in FIGS. 1 and 3, the insert system 38 is comprised of three layers. While three layers are depicted, a greater or fewer number of layers may be used. The following describes two layers of foam coupled with a middle polymeric layer, but the polymeric material may be used by itself. Alternatively, a single polymeric layer may be used sandwiched between two foam layers. Further, while foam is used, other similar materials may be used instead of foam.

An upper layer 52 of the insert system 38 may be comprised of foam. The upper foam layer 52 has an upper surface 54 and a lower surface 56. The upper surface 54 may be located in direct contact with the outer surface 32 of the insole 16. The lower surface 56 may be located in direct contact with an upper surface of a middle layer 57 (described below) of the system.

A lower layer 58 may also be comprised of foam. The lower foam layer 58 has an upper surface 60 and a lower surface 62. The upper surface 60 may be located in direct contact with a lower surface of the middle layer 57 (described below). The lower surface 62 may be located in direct contact with the inner surface 26 of the outsole 14.

Preferably, the upper, middle and lower layers 52, 57, 58 have a complementary perimeter 64 to one another, although this is not required. The layers 52, 57, 58 also need not have the same thickness. For example, in the depicted embodiment, the middle layer 57 is thicker than the individual upper and lower layers 52, 58.

FIGS. 1 and 3 depict the insert system 38 having a particular shape, such as a hexagonal. The present invention, however, is not limited to this shape. Instead, the insert system 38 may be of any shape. Further, while FIGS. 1 and 3 depict the layers 52, 57, 58 of the system 38 having all the same outline, the different layers 52, 57, 58 may have different shapes.

Figure 2:
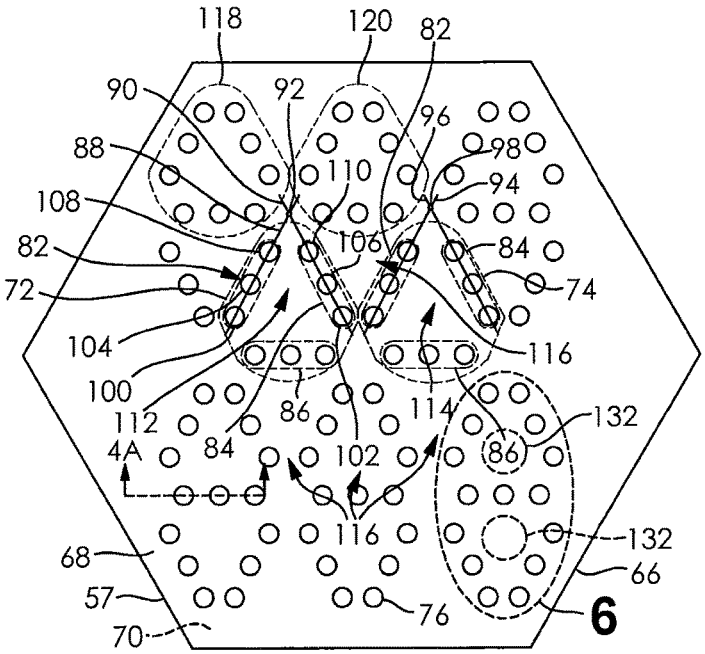
FIG. 2 is a top view of a layer of material from FIG. 1.

Turning now to FIG. 2, one embodiment of the middle layer 57 is depicted. As mentioned above, while the foregoing has described the insert system 38 as having at least one layer, it is within the scope of the present invention for the insert system 38 to be only a single layer. As a result, the following will transition from the discussion of a middle layer 57 to an insert 66 since the insert 66 can be used by itself or with other layers 52, 58.

The insert 66 is preferably a one-piece, unitary and integrally formed sheet of material. In one embodiment, the insert 66 may be 0.25 mm to 2 mm thick and fabricated from a polymer thermoplastic material. Such a material is widely available, inexpensive and readily disposable. The insert 66 is not limited to the thickness dimensions provided above and it may be thicker or thinner.

The insert 66 may be produced by injection molding, but other production methods are permissible. In one embodiment, the insert 66 may be produced by 3-D printing. Alternatively, a portion of the insert 66 may be injected molded and another portion produced by 3-D printing.

The insert 66 has a first surface 68 and a second surface 70. Using the example from above, the first, or upper, surface 68 is the surface in direct contact with the outer surface 32 of the insole 16 and the second, or lower, surface 70 is the surface in direct contact with the inner surface 30 of the outsole 14.

In the depicted embodiment, the first and second surfaces 68, 70 are substantially planar as well as parallel one another. This provides for a substantially constant thickness of the insert 66 between the first and second surfaces 68, 70.

The insert 66 has a first set of open spaces 72 and a second set of open spaces 74. For the purposes of the following discussion, the first set of open spaces 72 are located directly adjacent the second set of open spaces 74 on the insert 66. The invention, however, does not require the first and second sets 72, 74 to be in this orientation or location with respect to one another. Instead, the first set 72 may be distant from the second set 74 on or in the insert 66.

Figure 4A:
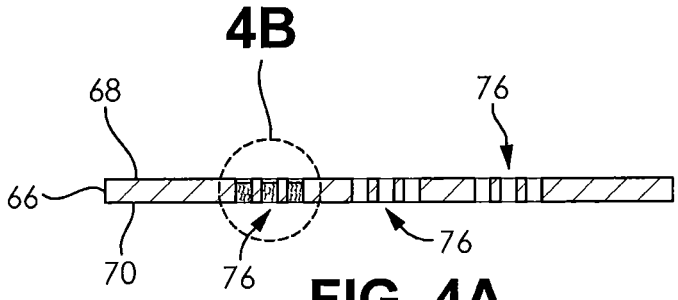
FIG. 4A is a cutaway side view along line 4A-4A of FIG. 2.
Figure 4B:
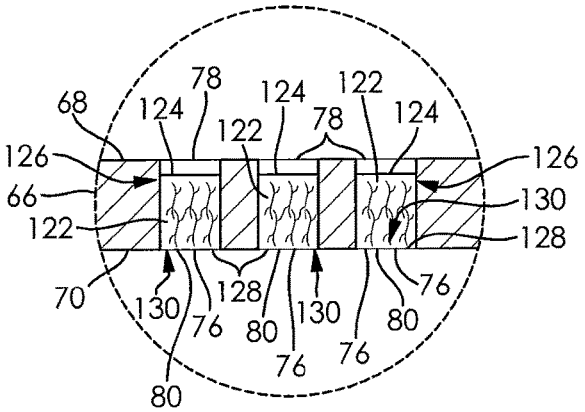
FIG. 4B is a detail from FIG. 4A.
Figure 5A:
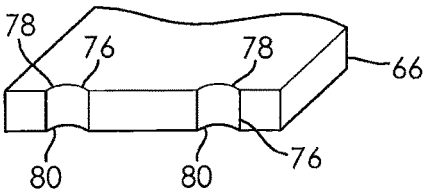
FIG. 5A is a cutaway side view of open spaces of the layer of material in a first condition.

The individual open spaces 76 are depicted as cylindrical with circular cross-sections (as shown in FIGS. 4A, 4B and 5A), however, it can be appreciated that other shapes, numbers, designs and/or orientations are permissible.

The open spaces 76 are shown to have circular openings 78, 80 at the first and second surfaces 68, 70, however, other shapes of the open spaces 76 are permissible. Further, while FIG. 1 depicts the open spaces 76 having all the same size and shape, it can be appreciated that the size and shape of the open spaces 76 can vary. The opens spaces 76 in FIG. 1 are in a first state where a force has not been applied to the insert 66.

Continuing with the discussion of the first and second sets of open spaces 72, 74 being directly adjacent one another, as can be seen in FIGS. 2 and 4, they are mirror images of one another. In fact, it is preferred that the insert 66 is comprised of repeating sets of open spaces where the sets are the same.

In the preferred embodiment, the first set of open spaces 72 and the second set of open spaces 74 are each comprised of first 82, second 84 and third 86 arrays of open spaces. It is also preferred that each array 82, 84, 86 is comprised of three open spaces 76. As shown in FIG. 2, the arrays 82, 84, 86 are arranged in a triangular pattern.

As can be appreciated from FIG. 4A, at least some of the open spaces 76 of the first set 72 and at least some of the open spaces 76 of the second set 74 extend from the first surface 68 of the insert 66 to the second surface 70 of the insert 66.

As noted above, the arrays 82, 84, 86 of open spaces in a set are preferably arranged to form a triangular pattern. More preferably, the arrays 82, 84, 86 of open spaces are in a particular triangular pattern. For example, the arrays 82, 84, 86 may be arranged to form acute angles between one another.

A further example of the arrangement of the arrays 82, 84, 86 is that the arrays of open spaces in the first set 72 are arranged so that a first imaginary line 88 extending from the first array 82 and a second imaginary line 90 extending from the second array 84 meet at a first point 92 outside of the first set 72. Similarly, the arrays 82, 84, 86 of open spaces in the second set 74 are arranged so that a first imaginary line 94 extending from the first array 82 and a second imaginary line 96 extending from the second array 84 meet at a second point 98 outside of the second set 74 as shown on FIG. 2.

Preferably, the first and second points 92, 98 are collinear with one another. The points 92, 98 may be collinear with the third arrays 86 in the first and second sets 72, 84.

As a further example of the preferred arrangement of open spaces, a first open space 100 in the first array 82 and a first open space 102 in the second array 84 are collinear. And, because the open spaces in the first and second arrays 82, 84 are lined up with one another and equally spaced apart from one another, a second open space 104 in the first array 82 and a second open space 106 in the second array 84 are also collinear. The same arrangement is provided between the third open spaces of the two arrays 82, 84.

With continued reference to FIG. 2, it can be seen that the first set of open spaces 72 and the second set of open spaces 74 each have the third array 86 of open spaces. The third array 86 of open spaces are collinear to form the base of one triangular shape of the set of open spaces 72, 74. The open spaces in each third array 86 are collinear and each third array 86 of each of the first and second sets 72, 74 of open spaces are collinear.

The third arrays 86 of the first and second sets of open spaces 72, 74 are axially offset from the first and second arrays 82, 84 of each sets. In other words, the third arrays 86 of the first and second sets of open spaces 72, 74 do not axially overlap with the first and second arrays 82, 84.

Preferably, back to back sets of open spaces 82, 84 share the same third array 86 as shown in FIG. 2.

Preferably, the first, second and third arrays 82, 84, 86 of the first set 72 bound an unperforated area 112 between the arrays. Further, the first, second and third arrays 82, 84, 86 of the second set 74 bound an unperforated area 114 between the arrays 82, 84, 86. As can be seen from FIG. 2, the other arrays of the other sets also bound unperforated areas between the arrays.

In addition, there is an unperforated area 116 between the arrays 82, 84, 86 of the first set 72 and the arrays 82, 84, 86 of the second set 74. From FIG. 2 it can be seen that there are unperforated areas 116 between the other sets on the insert 66 as well.

As used above, the term unperforated means that there are no open areas in that region of the insert 66. In other words, the unperforated areas are continuous, unitary, one-piece and integrally formed of a polymeric material, or the material of the insert 66.

As noted above, the insert 66 comprises additional sets of open spaces beyond just the first and second sets of open spaces 72, 74. By way of example, a third set of open spaces 118 and a fourth set of open spaces 120 will be described. While a third and fourth set of open spaces 118, 120 are described the present invention is not limited to just four sets of open spaces. Instead, the invention may utilize a plurality of sets of open spaces.

In the depicted embodiment, the third set of open spaces 118 and the fourth set of open spaces 120 are axially offset from the first set of open spaces 72 and the second set of open spaces 74. More preferably, the third and fourth sets of open spaces 118, 120 are axially offset so that the first point 92 formed from the imaginary lines 88, 90 extending from the first array 82 and the second array 84 of the first set of open spaces 72 is located between the third set of open spaces 118 and the fourth set of open spaces 120. Further, the second point 98 of the second set of open spaces 74 is located between two sets of open spaces.

Whether there are two sets of open spaces or a plurality of sets of open spaces, it is preferred that each of the first arrays 82 of each set of open spaces extend parallel one another and each of the second arrays 84 of each of the open spaces extend parallel one another. Further, each of the third arrays 86 of each of the sets extend parallel one another.

Figure 5B:
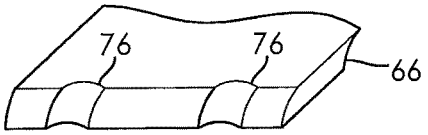
FIG. 5B is a cutaway side view of the open spaces of FIG. 5B in a second condition.

Turning now to FIGS. 5A and 5B, two of the open spaces 76 are depicted. In FIG. 5A, the open spaces 76 are in a first state, in which a force has not acted on the insert 66 or the open spaces 76. FIG. 5B depicts the same open spaces 76 but subject to a force. The force deforms the open spaces 76 resulting in dissipation of the force. In FIG. 5B, the open spaces 76 are deformed as a result of one kind of force from a circular cross-section to an oval cross-section. The shape change of the open spaces 76 expends some or all of the energy of the force traveling through the insert 66.

In one example, because the insert 66 maintains a constant volume, when a force encounters an open space 76, the force deforms the open space 76. The deformed open space compresses the adjacent open space 76 or spaces 76. The combination of deformation and compression of the open spaces 76 results in force dissipation.

One kind of force, such as caused by a shearing action, may travel through the insert 66 in a wave or waves. The waves may travel along an outer surface of the insert 66, such as the first and/or second surfaces 68, 70 and/or through the body of the insert 66. The shearing force can be applied substantially at once, it can be repeated, and/or it can increase or decrease in intensity.

Another kind of force is a force that is normal to the insert 66. The normal force can be applied substantially at once, it can be repeated, and/or it can increase or decrease in intensity.

Figure 5C:
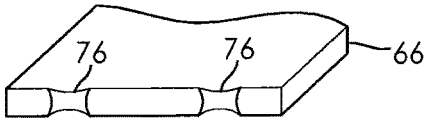
FIG. 5C depicts a second embodiment of deformation of the open spaces.

FIG. 5C depicts the open spaces 76 of FIG. 5A subject to a force substantially normal to the insert 66. In this condition, the open spaces 76 may deform into an hourglass shape. In other words, the width of the open space between the opening 78 on the first surface 68 and the opening 80 on the second surface 70 becomes smaller compared to an undeformed body. The open space 76 deformation leads to energy dissipation in the same manner described above. In particular, it is preferred that normal or near normal forces applied to the insert 66 are dissipated laterally with respect to the orientation of the open spaces 76.

While FIGS. 5B and 5C depict the two open spaces 76 both deformed to dissipate a force, it can be appreciated that only one or the other open spaces 76 might be deformed. In addition, one open space 76 may be deformed to a greater or lesser extent than an adjacent open space 76 depending on where the force is applied and what kind of force is applied. Further, while FIG. 5B depicts the open spaces 76 deformed into oval cross-sections, and FIG. 5C depicts the open spaces 76 deformed into hour-glass cross-sections, they may be deformed into other shapes and/or the shapes do not have to match one another.

The open spaces 76 are located in the insert 66 to maximize tensile strength of the insert 66. The locations of the open spaces 76 are also optimized to dissipate normal forces to the insert 66, as well as other forces. The effectiveness of the open spaces 76 in dissipating forces in the insert 66 minimizes the thickness of the insert 66, which leads to more comfortable footwear 10.

Turning now to FIGS. 4A and 4B, some of the open spaces 76 of the insert 66 are depicted. As can be appreciated from the figures, in these embodiments some of the open spaces 76 are continuous, hollow, cylindrical shaped tubes that extend from the first surface 68 to the second surface 70 of the insert 66. The open spaces 76 preferably extend substantially perpendicular to the general orientation of the midsole 18.

The open spaces 76 are not filled with any medium, except that air may freely flow along the length of the open spaces 76 and into and out of the open spaces 76. It is preferred that the open spaces 76 are not provided with a closure on either end, although it is appreciated that the foam layers 52, 58 or the insole or outsole 14, 16 may cover the open spaces 76.

In one embodiment, at least one of the open spaces 76 is at least partially filled with a viscous fluid 122, such as a liquid. The fluid 122 is contained within the open space 76 by at least one closure. More particularly, a first closure 124 is provided at an upper portion 126 and a second closure 128 is provided at a lower portion 130 of the open space 76 to enclose the fluid 122 therein and prevent it from escaping.

Preferably, the first and second closures 124, 128 are sufficient to trap the fluid 122 within the open space 76 because they are fluid tight and the walls of the open space 76 through the insert 66 are also fluid tight. It is possible, however, that an enclosed capsule (not shown) can be permanently or removably inserted into the open space 76. The capsule can enclose the fluid 122 and prevent it from escaping. The capsule has a complementary shape and size to the open space 76.

As shown in the figures, it is preferred that the fluids 122 in the open spaces 76 do not communicate with one another. In other words, the open spaces 76 are sealed from one another in a fluid tight manner. It may be desirable, however, for one or more of the spaces 76 to communicate fluid 122 between them and this is within the scope of the invention.

As best seen in FIG. 4B, the open spaces 76 may be at least partially filled with the fluid 122. While FIG. 4B shows the open spaces 76 filled approximately four fifths of the way, the open spaces 76 may be entirely filled or filled to a lesser degree. Further, while the open spaces 76 in FIG. 4 B show all of the open spaces 76 filled the same amount, the individual open spaces 76 can have their own individual fill levels.

Preferably, the viscous fluid 122 is an energy absorbing fluid. The energy absorbing fluid may be such as a shear thickening fluid comprised of a suspension of nanoparticles inside a polymer matrix, or fibrous matrix. The fibrous matrix may be used to hold the viscous fluid or the nanosuspension. The nanoparticles may be such as multiwall carbon nanotubes.

Colloidal suspensions of nanoparticles have a natural resistance to flow due to random collisions between the particles. A high velocity impact onto the insert 66 that is filled with nanoparticles suspended in a fluid imposes shear forces on the particles. When the shear rate increases beyond a certain threshold value, the viscosity of the fluid increases suddenly due to hydrodynamic interactions between particles that lead to transient fluctuations in particle concentration and the formation of so-called hydroclusters. The viscosity increases in a matter of milliseconds after receiving a force and causes the fluid to stiffen, and thus the insert 66 becomes stiff as well.

Typical separation distances between particles in these hydroclusters are in the range of nanometers. The onset of shear thickening is related to the size of the submicron particles and their volume fraction in the suspension. The onset of shear thickening can be modified by changing not only the particle size, but also the particle surface structure and chemical functionality. Surface roughness plays an important role, and the surface of particles can be further modified by adsorption of ions, surfactants, and polymers. During the shear-thickening event, a significant amount of impact energy is dissipated as the fluid stiffens, and within a few seconds after the event, the fluid returns to its original liquid like state.

The shear-thickening event consumes energy as the structure of the nanofluid changes, and the stiffening of the entire structure dissipates a significant amount of the impact energy without transmitting it to the foot 34. Furthermore, the energy absorption can be tuned for a given range of impact energies by modification of the composition of nanofluids. The tuning of the nanofluid properties is based on the following principles: In the shear thickening range of Brownian suspensions, the slope of the viscosity-shear rate curve tends to increase as the solid particle volume fraction increases. The onset of shear thickening of a nanosuspension occurs at a universal value of the Peclet number, Pe:

$$Pe = \frac{\eta_s \dot{\gamma} a^3}{k_B T} \propto \dot{\gamma} t_D$$

where $\eta_s$ is the viscosity of the suspending fluid, $\gamma$ the shear rate, a the radius of the solid particles, $k_B$ the Boltzmann constant, T the absolute temperature, and $t_D$ the time for a particle to diffuse a distance equal to is radius a. From this, the critical shear rate for the onset of shear thickening can be deduced to be proportional to the inverse of the cube of the particle radius.

Additional tuning of the properties can be achieved through electrostatic charges and deformations of the steric stabilizing layer that can become important when small particles are mixed into a fluid. Therefore, particles with long-ranged repulsive interparticle potentials are expected to be most shear thickening. This opens the opportunity to modify the repulsive interparticle potentials by chemically functionalizing the surface of the particles with epoxy groups, hydroxyl groups, carboxyl groups, or amino groups. By changing variables such as particle type, particle size, surface functional groups, and particle/fluid weight ratio, it is possible to tune the range where the insert responds dynamically and stiffens up for a given shoe application, such as different types of sports shoes or working boots, where very different ranges of impact energies and velocities of impacting objects are encountered.

One embodiment uses non-Newtonian fluids that are chemically compatible with thermoplastic polymers, and incorporates the fluids into internal cavities or small channels in a thermoplastic polymer matrix. Non-Newtonian fluids are fluids whose viscosity (a measure of a fluids resistance to deformation by shear or tensile stresses) is dependent on the shear rate. Examples of such fluids are salt solutions, starch suspensions, and molten polymers.

Another embodiment of the invention uses shear-thickening solid liquid suspensions that exhibit increased viscosity when exposed to shear forces. Examples of such solid/liquid suspensions are:

a) submicron-size silicon oxide particles in USP grade polyethylene glycol (PEG);

b) submicron-size colloidal silicon oxide particles in USP grade glycerin;

c) silicon nanoparticles in USP grade glycerin;

d) silicon nanoparticles in USP grade polyethylene glycol (PEG);

e) silicon dioxide nanoparticle in singular or binary mixtures in polyethylene glycol (PEG 200 and PEG 400);

f) silicon dioxide nanoparticles functionalized with linear hydrocarbons in singular or binary mixtures in polyethylene glycol (PEG 200 and PEG 400);

g) silicon dioxide nanoparticles functionalized with silanes in singular or binary mixtures in polyethylene glycol (PEG 200 and PEG 400);

h) bentonite or kaolin clay ($Al_2Si_2O_7$) particles in USP grade glycerin;

i) bentonite or kaolin clay ($Al_2Si_2O_7$) particles in USP grade polyethylene glycol (PEG);

j) polycaprolactone particles in USP grade polyethylene glycol (PEG);

k) salt solutions;

l) starch suspensions; and/or m) molten polymers.

In addition to these examples, many other solid particle-liquid combinations can be used to achieve shear thickening behavior. Depending on the shear rate and the amount of shear force, these suspensions can stiffen and thereby increase the energy absorption ability of the insert by diverting the impact energy into the fluid filled open spaces and directing the impact forces away from the foot 34. When the shear stress is removed, the nanosuspension inside the insert returns to its original, non-shear thickened state with lower viscosity.

The fluid 122 may be filled with nanosuspensions that are tuned to exhibit a maximum dynamic response at a given trigger impact force. Tunable response where impact energies of different magnitudes can be dissipated can be achieved by incorporating nanosuspensions formulated with nanoparticles functionalized with linear hydrocarbons or with silanes. A range of nanosuspensions may be used that undergo shear thickening in dynamic response to peak forces and shear rates analogous to an impact event characteristic to a given activity or anticipated force(s).

The fluid 122 may also be filled with force dampening fluids such as glycerin and polyethylene glycol that do not undergo shear thickening.

Figure 6:
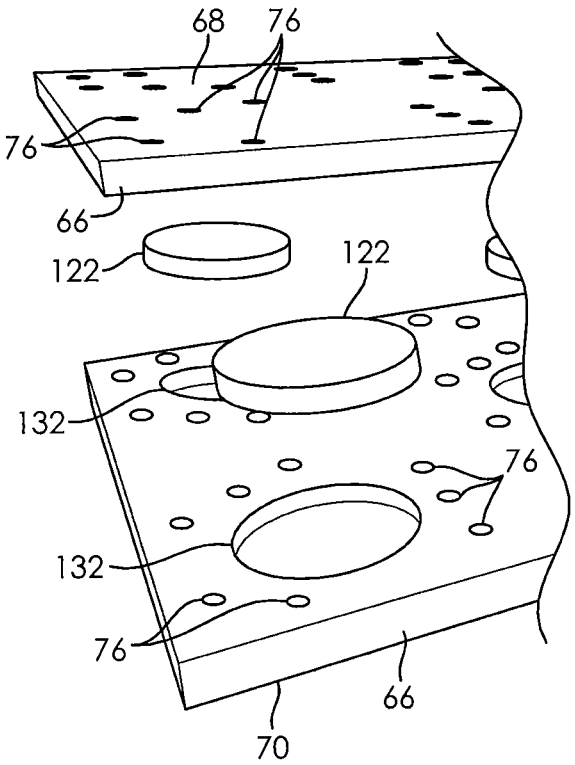
FIG. 6 depicts a detail from FIG. 2 comprising an exploded view of an embodiment of the layer of material.

Turning now to FIG. 6 a detail from FIG. 2 is provided. The detail from FIG. 2 is from one portion of the insert 66. While one portion of the insert 66 is depicted as having the features of FIG. 6, the insert 66 may have these features throughout, in certain sections of the insert 66 or not in the insert 66 at all. Preferably, the features shown in FIG. 6 are located throughout out the insert for each of the sets of open spaces (e.g., 72, 74, 118, 120, etc).

FIG. 6 depicts an exploded view of the insert 66. FIG. 6 suggests that the insert 66 has separate upper and lower layers, and this may be the case, but the preferred embodiment is for the insert 66 to be formed of a one-piece, unitary, integrally formed material, except as noted below.

As shown in FIG. 6 one embodiment of a pocket 132 in the insert 66 is depicted. While the pocket 132 is depicted as having a round perimeter of a particular size, the pocket 132 is not limited to this shape or size. Instead, the pocket 132 may have any shape or size. It is preferable however, that the pocket 132 remain within the bounds defined by the first, second and third arrays 82, 84, 86 of the set of open spaces (e.g, 72, 74, 118, 120) in which it is located. Most preferably, the pocket 132 is centered within the set of open spaces (e.g., 72, 74, 118, 120).

The pocket 132 preferably comprises a depression or recess within the insert 66. The depression is preferably centered within the insert 66 but it may be offset toward the insert first surface 68 or insert second surface 70.

The pocket 132 does not extend all the way through the insert 66. In other words, the pocket 132 does not extend through the insert first surface 68 or the insert second surface 70. Instead, the pocket 132 is entirely encapsulated, enclosed and contained within the insert 66. Based on this it can still be appreciated that the insert 66 can still have unperforated areas between the arrays 82, 84, 86, such as 112 and 114 disclosed above.

Fluid 122, as described above, is preferably located within the pocket 132. In one embodiment, the fluid 122 entirely fills the pocket 132, however, it is permissible for the pocket 132 to only be partially filled with the fluid 122. It is also permissible for some pockets 132 to be filled entirely or partially with fluid 122 and other pockets 132 remain unfilled with fluid 122 but instead contain a gas, such as air, or an inert gas, such as nitrogen or argon.

Preferably, if any fluid 122 of any amount is located in any pocket 132, that pocket 132 is fluid tight. More particularly, the portion of the insert 66 comprising the pocket 132 is fluid tight. The portion of the insert 66 comprising the pocket 132 can be made fluid tight by virtue of the material the insert 66 is constructed of being non-porous and without any structure to leak or convey the fluid 122 and/or by a fluid proof-type coating applied to the pocket 132.

Based on the fact that different inserts 66 can be created with or without pockets 132 that are or are not filled with fluid or other substances, it can be appreciated that inserts 66 with these various features can be located throughout the footwear 10 and/or used in combination with one another. For example, two or more inserts 66 with different features can be stacked at a single location in the footwear 10. More particularly, one insert 66 with pockets 132 filled with fluid 122 can be located adjacent (such as above, below or beside) a second insert 66 that does not have pockets or whose pockets 132 are filled with an inert gas.

Further, these different inserts 66 can be located in the same layer of the footwear 10, such as in the midsole 18, but also in other layers. For example, one insert 66 with pockets 132 filled with fluid 122 may be located in the midsole 18 and a second insert 66 that has pockets 132 filled with an inert gas or nothing, or have no pockets, may be located in the insole 16 or outsole 14.

Regardless of location or insert type, the fluid 122 functions in the pockets 132 as described above so that impacts onto or into the insert 66 with fluid 122 filled pockets 132 cause the fluid to stiffen. The fluid 122 stiffens thereby increasing the energy absorption ability of the insert 66 by diverting the impact energy into the open spaces 76 causing them to deform and laterally dissipate energy through the insert 66 to direct the impact forces away from the foot 34. When the shear stress is removed, the fluid 122 inside the insert 66 returns to its original, non-shear thickened state with lower viscosity.

From the foregoing, it can be appreciated that the insert 66 material, the location of that material in the footwear 10, the open spaces 76, and/or plastic and/or elastic deformation of the insert 66 material and particularly the open spaces 76, and the use of shear thickening fluids 122, effectively diminishes forces transmitted in the axial (normal) direction, as well as in the horizontal direction.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. An energy absorbing element for footwear, comprising:

a first set of open spaces and a second set of open spaces in a layer of material, wherein said first set of open spaces and said second set of open spaces are each comprised of three arrays of open spaces, wherein each array is comprised of three open spaces, wherein the arrays are arranged in a triangular pattern;

wherein said layer of material is fixed within a pocket in a shoe sole layer, said pocket defined by walls of the shoe sole layer;

wherein said layer is a polymer thermoplastic material;

a single fluid tight pocket within said layer of material not in fluid communication with any other pockets wherein said pocket is entirely encapsulated within a planar upper surface and a planar lower surface of said layer of material and said pocket is located within one of said sets of open spaces and within said triangular pattern formed by said three open spaces of said three arrays, said open spaces located in close, surrounding proximity to said pocket for forces to transmit laterally from said pocket to said open spaces through said material for further dissipation by said open spaces; and a shear thickening fluid entirely filling said pocket, said shear thickening fluid comprising a nanosuspension of nanoparticles in a fiberous matrix.

2. The energy absorbing element for footwear of claim 1, wherein said layer of material is an insert that can be located into said a layer of said footwear.

3. The energy absorbing element for footwear of claim 2, wherein the first and second set of open spaces extend from a first side of said insert to a second side of said insert.

4. The energy absorbing element for footwear of claim 3, wherein said first side and said second side of said insert are planar and define a constant thickness between them.

5. The energy absorbing element for footwear of claim 1, wherein the first and second sets of open spaces are mirror images of one another.

6. The energy absorbing element for footwear of claim 1, wherein an imaginary line extending through centers of said open spaces of a first array and an imaginary line extending through centers of said open spaces of a second array of each of said first and second sets meet at points outside of said first and said second sets, wherein said points are collinear.

7. The energy absorbing element for footwear of claim 1, wherein an imaginary line extending through a center of a first open space in said first array and through a center of a first open space in said second array is parallel with an imaginary line extending through a center of a second open space in said first array and through a center of a second open space in said second array.

8. The energy absorbing element for footwear of claim 1, wherein an imaginary line extending through centers of said third array of said first set of open spaces and an imaginary line extending through centers of said third array of said second set of open spaces are parallel.

9. The energy absorbing element for footwear of claim 8, wherein said third arrays of said sets of open spaces are axially offset from said first and second arrays so that said third arrays do not axially overlap with said first and second arrays.

10. The energy absorbing element for footwear of claim 1, further comprising a third set of open spaces and a fourth set of open spaces, wherein said third set of open spaces and said fourth set of open spaces are axially offset from said first set of open spaces and said second set of open spaces so that said point of said imaginary lines extending from said first array and said second array of said second set of open spaces meet between said third set of open spaces and said fourth set of open spaces.

11. The energy absorbing element for footwear of claim 1, wherein each of said first arrays of each set of open spaces extend parallel one another and each of said second arrays of each of said open spaces extend parallel one another.

12. The energy absorbing element for footwear of claim 1, wherein said arrays are arranged at an acute angle with respect to one another.

13. The energy absorbing element for footwear of claim 2, further comprising a first foam layer located above said insert and a second foam layer located below said insert.

14. The energy absorbing element for footwear of claim 13, wherein said foam layer is thicker than the upper layer of material or the lower layer of material.

15. The energy absorbing element for footwear of claim 1, wherein at least one of the open spaces is at least partially filled with said nanosuspension and multiwall carbon nanotubes.

16. The energy absorbing element for footwear of claim 2, wherein the insert is located in a midsole of the footwear with a footwear layer above the insert and a footwear layer below the insert.

17. The energy absorbing element for footwear of claim 16, wherein said open spaces are perpendicular to the midsole.

18. A method of absorbing energy in an energy absorbing element for footwear, comprising:

arranging a first set of open spaces and a second set of open spaces in a layer of material within said footwear, wherein said first set of open spaces and said second set of open spaces are each comprised of three arrays of open spaces, wherein each array is comprised of three open spaces, wherein the arrays are arranged in a triangular pattern, wherein said layer of material is fixed within a pocket in a shoe sole layer, said pocket defined by walls of the shoe sole layer;

wherein said layer is a polymer thermoplastic material;

providing a single fluid tight pocket within said layer of material not in fluid communication with any other pockets wherein said pocket is entirely encapsulated within a planar upper surface and a planar lower surface of said layer of material and said pocket is located within one of said sets of open spaces and within said triangular pattern formed by said three open spaces of said three arrays, said open spaces located in close, surrounding proximity to said pocket for forces to transmit laterally from said pocket to said open spaces through said material for further dissipation by said open spaces; and locating said layer of material below a first material in said footwear and above a second material in said footwear, said first and second materials being different from said layer of material;

locating a shear thickening fluid comprised of a suspension of nanoparticles inside a polymer matrix within said single fluid tight pocket;

dissipating a force applied to said single fluid tight pocket by absorbing said force via a stiffing of said shear thickening fluid in said single fluid tight pocket upon receipt of said force;

relaxing said stiffened shear thickening fluid after said force is dissipated to return said shear thickening fluid to a non-shear thickened state.

19. The method of claim 18, wherein said force applied to said fluid tight enclosure is substantially normal to said enclosure.

20. The method of claim 19, wherein said force is applied to normal to said first or second set of open spaces causing boundaries of said open spaces to deform to redirect said force laterally through said layer of material.

21. An energy absorbing element for footwear, comprising:

a first set of open spaces and a second set of open spaces in a layer of material, wherein said first set of open spaces and said second set of open spaces are each comprised of three arrays of open spaces, wherein each array is comprised of three open spaces, wherein the arrays are arranged in a triangular pattern, wherein an imaginary line extending through centers of said open spaces of a first array and an imaginary line extending through centers of said open spaces of a second array of each of said first and second sets meet at points outside of said first and said second sets, wherein said points are collinear, wherein an imaginary line extending through a center of a first open space in said first array and through a center of a first open space in said second array is parallel with an imaginary line extending through a center of a second open space in said first array and through a center of a second open space in said second array;

wherein an imaginary line extending through centers of said third array of said first set of open spaces and an imaginary line extending through centers of said third array of said second set of open spaces are parallel;

wherein said layer is a polymer thermoplastic material;

a single fluid tight pocket within said layer of material not in fluid communication with any other pockets wherein said pocket is entirely encapsulated within a planar upper surface and a planar lower surface of said layer of material and said pocket is located within one of said sets of open spaces and within said triangular pattern formed by said three open spaces of said three arrays, said open spaces located in close, surrounding proximity to said pocket for forces to transmit laterally from said pocket to said open spaces through said material for further dissipation by said open spaces; and a shear thickening fluid entirely filling said pocket, said shear thickening fluid comprising a nanosuspension of nanoparticles in a fiberous matrix.

22. The energy absorbing element for footwear of claim 21, wherein said third arrays of said sets of open spaces are axially offset from said first and second arrays so that said third arrays do not axially overlap with said first and second arrays.

23. An energy absorbing element for footwear, comprising:

a first set of open spaces and a second set of open spaces in a layer of material, wherein said first set of open spaces and said second set of open spaces are each comprised of three arrays of open spaces, wherein each array is comprised of three open spaces, wherein the arrays are arranged in a triangular pattern; and wherein said layer of material is fixed within a pocket in a shoe sole layer, said pocket defined by walls of the shoe sole layer;

wherein said layer is a polymer thermoplastic material;

a single fluid tight pocket within said layer of material not in fluid communication with any other pockets wherein said pocket is entirely encapsulated within a planar upper surface and a planar lower surface of said layer of material and said pocket is located within one of said sets of open spaces and within said triangular pattern formed by said three open spaces of said three arrays, said open spaces located in close, surrounding proximity to said pocket for forces to transmit laterally from said pocket to said open spaces through said material for further dissipation by said open spaces; and a shear thickening fluid entirely filling said pocket, said shear thickening fluid comprising a nanosuspension of nanoparticles in a fiberous matrix.

* * * * *